US008735031B2

(12) United States Patent
Nebashi et al.

(10) Patent No.: US 8,735,031 B2
(45) Date of Patent: May 27, 2014

(54) ELECTROPHOTOGRAPHIC PHOTORECEPTOR, PROCESS FOR PRODUCING THE ELECTROPHOTOGRAPHIC PHOTORECEPTOR, AND ELECTROPHOTOGRAPHIC DEVICE

(75) Inventors: Kazuki Nebashi, Matsumoto (JP); Yoichi Nakamura, Matsumoto (JP); Ikuo Takaki, GuangDong (CN); Seizo Kitagawa, Matsumoto (JP); Shinjiro Suzuki, Matsumoto (JP)

(73) Assignee: Fuji Electric Co., Ltd., Kawasaki-Shi (JP)

( * ) Notice: Subject to any disclaimer, the term of this patent is extended or adjusted under 35 U.S.C. 154(b) by 193 days.

(21) Appl. No.: 13/132,031

(22) PCT Filed: Nov. 27, 2009

(86) PCT No.: PCT/JP2009/070046

§ 371 (c)(1),
(2), (4) Date: Sep. 16, 2011

(87) PCT Pub. No.: WO2010/064585

PCT Pub. Date: Jun. 10, 2010

(65) Prior Publication Data

US 2012/0034556 A1 Feb. 9, 2012

(30) Foreign Application Priority Data

Dec. 1, 2008 (JP) ..... 2008-306109

(51) Int. Cl.
*G03G 5/14* (2006.01)

(52) U.S. Cl.
USPC ..... 430/60; 430/63; 430/65; 430/131; 399/159

(58) Field of Classification Search
CPC ..... G03G 5/142; G03G 5/144
USPC ..... 430/63, 65, 60; 399/159
See application file for complete search history.

(56) References Cited

U.S. PATENT DOCUMENTS

| | | | | |
|---|---|---|---|---|
| 5,279,914 | A * | 1/1994 | Aizawa et al. | 430/58.15 |
| 2007/0154827 | A1 * | 7/2007 | Suzuki et al. | 430/60 |

FOREIGN PATENT DOCUMENTS

| | | | |
|---|---|---|---|
| JP | 52-025638 | A | 2/1977 |
| JP | 52-100240 | A | 8/1977 |
| JP | 53-089435 | A | 8/1978 |
| JP | 54-026738 | A | 2/1979 |
| JP | 57-151949 | A | 9/1982 |
| JP | 58-106549 | A | 6/1983 |
| JP | 2-060177 | A | 2/1990 |
| JP | 3139381 | A | 6/1991 |

(Continued)

*Primary Examiner* — Christopher Rodee
(74) *Attorney, Agent, or Firm* — Rabin & Berdo, P.C.

(57) ABSTRACT

An electrophotographic photoreceptor includes an electroconductive substrate; an undercoat layer provided on the electroconductive substrate and composed of: metal oxide fine particles including particles of at least one metal oxide and at least one organic compound provided on the particles of the at least one metal oxide as a surface treatment; and a copolymer resin synthesized by copolymerization of essential constituent monomers composed of a dicarboxylic acid, a diol, a triol and a diamine; and a photosensitive layer laminated on the undercoat layer. The undercoat layer permits (a) attaining stable electric potential characteristics in all environments ranging from low temperature and low humidity environments to high temperature and high humidity environments, (b) suppressing the occurrence of printing defects and density differences, and (c) simultaneously attaining transfer restorability and restorability from intense light-induced fatigue even in a wide variety of usages and operation environments.

17 Claims, 3 Drawing Sheets

(56) References Cited

FOREIGN PATENT DOCUMENTS

| | | | | |
|---|---|---|---|---|
| JP | 5-088396 | A | | 4/1993 |
| JP | 6-102693 | A | | 4/1994 |
| JP | 8-262776 | A | | 10/1996 |
| JP | 2001-209201 | A | | 8/2001 |
| JP | 2002-006524 | A | | 1/2002 |
| JP | 2002107984 | A | * | 4/2002 |
| JP | 2003-223011 | A | | 8/2003 |
| JP | 2007-178660 | A | | 7/2007 |
| WO | WO 2010071118 | A1 | * | 6/2010 |

* cited by examiner

ELECTROPHOTOGRAPHIC PHOTORECEPTOR, PROCESS FOR PRODUCING THE ELECTROPHOTOGRAPHIC PHOTORECEPTOR, AND ELECTROPHOTOGRAPHIC DEVICE

BACKGROUND OF THE INVENTION

1. Field of the Invention

The present invention relates to an electrophotographic photoreceptor (hereinafter, also referred to as a photoreceptor) of laminated type and single layer type having a photosensitive layer containing an organic material, which is used in electrophotographic devices such as printers, copying machines and facsimiles employing an electrophotographic system, a process for producing the electrophotographic photoreceptor, and an electrophotographic device mounted with the photoreceptor.

2. Background of the Prior Art

Electrophotographic photoreceptors are required to have a function of retaining surface charges in the dark, a function of receiving light and thereby generating electric charges, and a function of similarly receiving light and thereby transporting electric charges. Examples of such electrophotographic photoreceptors include so-called laminated type photoreceptors in which functionally separated layers such as a layer that contributes mainly to the generation of charges and a layer that contributes to the retention of surface charges in the dark and to the transport of charges upon light reception, are laminated; and so-called single layer type photoreceptors in which a single layer combines these functions.

In the formation of images according to an electrophotographic method using these electrophotographic photoreceptors, for example, Carlson's process is applied. The formation of an image by this system is carried out through electrostatic charging of a photoreceptor in the dark, formation of an electrostatic latent image on the surface of the charged photoreceptor under the effect of exposure in accordance with the characters or drawings in the manuscript, development of the formed electrostatic latent image using toner, and transfer and fixation of the formed toner image onto a support such as paper. After the transfer of the toner image, the photoreceptor is subjected to the removal of residual toner, charge elimination and the like, and then is provided for reuse.

Some of the electrophotographic photoreceptors described above make use of an inorganic photoconductive material such as selenium, a selenium alloy, zinc oxide or cadmium sulfide. In recent years, organic photoreceptors in which an organic photoconductive material that is advantageous in terms of thermal stability, film-forming properties and the like as compared with the inorganic photoconductive materials, is dispersed in a resin binder, have been brought to practical application and now constitute the mainstream. Examples of such an organic photoconductive material include poly-N-vinylcarbazole, 9,10-anthracenediol polyester, pyrazoline, hydrazone, stilbene, butadiene, benzidine, phthalocyanine, and bisazo compounds.

Among the organic materials that are used in these organic photoreceptors, the organic photoconductive materials which are in charge of the function of charge generation and the function of charge transport, are in many cases low molecular weight materials with less ability to form layers, and thus it has been difficult to form a photosensitive layer having durability. However, it has been made possible to produce an organic photoreceptor having a photosensitive layer with high durability and practical film strength, by subjecting such a low molecular weight material to primary dispersion or dissolution in a high molecular weight compound with greater ability to form layers (resin binder), and then forming a photosensitive layer.

Recently, the functionally separated laminated type photoreceptors described above, in which a charge generation layer containing a charge generating material and a charge transport layer containing a charge transporting material are laminated as photosensitive layers, are constituting the mainstream because, based on the rich variety of organic materials, a wide selection of materials appropriate for the various functions of the photosensitive layers allows a large degree of freedom in design.

Among others, negatively charged type photoreceptors in which a charge generation layer containing a photoconductive organic pigment is formed on an electroconductive substrate and a charge transport layer containing a charge transporting material is laminated on the charge generation layer, are now available as a variety of commercial products. Usually, this charge generation layer is formed into a film by vapor deposition of a photoconductive organic pigment, or is formed into a film by immersion coating from a coating liquid in which a photoconductive organic pigment is dispersed in a resin binder, and the charge transport layer is formed by immersion coating from a coating liquid in which a low molecular weight organic compound having a charge transport function is dispersed or dissolved in a resin binder.

Furthermore, positively charged type photoreceptors which use a single layer of photosensitive layer in which a charge generating material and a charge transporting material are all dispersed or dissolved in a resin binder, are also widely known.

When an electrophotographic photoreceptor to an electrophotographic device of Carlson's process system, the following matters frequently constitute problems to be solved.

(1) To improve adhesiveness between the photosensitive layer and the electroconductive substrate.

(2) To increase concealability against defects of the substrate surface or surface unevenness.

(3) To suppress the generation of defects such as black dots or white dots on a printed image, that are caused by unnecessary carrier injection from the electroconductive substrate.

Thus, in order to solve the problems of (1) to (3), it is known to insert an undercoat layer between the substrate and the charge generation layer of a laminated type photoreceptor or the photosensitive layer of a single layer type photoreceptor. As this undercoat layer, a layer of a resin such as a polymeric compound, or an anodic coating is conventionally used.

When the undercoat layer is formed from a resin such as a polymeric compound, it is known that the usage of a thermoplastic resin such as polyvinyl acetate, polyvinyl alcohol, polyvinyl butyral, polyester or polyamide, or of a thermosetting resin such as an epoxy resin, a urethane resin, a melamine resin or a phenolic resin, as the constituent material is under investigation, for example, Japanese Patent Application Laid-Open (JP-A) No. 52-100240 (Patent Document 1), JP-A No. 58-106549 (Patent Document 2), JP-A No. 54-26738 (Patent Document 3), JP-A No. 52-25638 (Patent Document 4), JP-A No. 53-89435 (Patent Document 5), and the like.

There is known an undercoat layer which is prepared by further dispersing metal oxide fine particles, and which therefore does not cause a significant decrease in sensitivity even if prepared into a thick film, while maintaining concealability against defects of the substrate surface. Furthermore, an undercoat layer which is prepared by dispersing organic compound-treated metal oxide fine particles and thereby exhibits effectiveness in electrical properties, is also already known, for example, Japanese Examined Patent Application (JP-B) No. 2-60177 (Patent Document 6), Japanese Patent No. 3139381 (Patent Document 7), and the like.

In addition, investigations have been hitherto conducted on various polymeric compound resins for their use in an undercoat layer which generally focuses on the countermeasures against memory generation that occurs in a low temperature and low humidity environment in which the undercoat layer attains high resistance, and the countermeasures against the occurrence of black dots or the occurrence of fogging defects in printed images in a high temperature and high humidity environment in which the undercoat layer attains low resistance. For example, JP-A No. 2002-6524 (Patent Document 8) discloses a mixture in which melamines and guanamines are applied as crosslinking agents to a polyester resin.

It is also reported in JP-A No. 2007-178660 (Patent Document 9) that when a resin containing a dicarboxylic acid and a diamine as constituent monomers at a defined composition ratio is applied, image characteristics that are satisfactory for all environments ranging from low temperature and low humidity environments to high temperature and high humidity environments, can be obtained.

Furthermore, there have been suggested attempts to solve the problem of light-induced fatigue by an improvement of the undercoat layer (intermediate layer). For example, JP-A No. 8-262776 (Patent Document 10) discloses an electrophotographic photoreceptor which contains an organometallic compound, a coupling agent and the like in the undercoat layer, and contains inorganic fine particles in the surface layer. JP-A No. 2001-209201 (Patent Document 11) also discloses an electrophotographic photoreceptor which uses an azo pigment and a phthalocyanine-based pigment as charge generating materials, and contains titanium oxide and a metal oxide in the undercoat layer. In these patent documents, descriptions on the effect on light-induced fatigue due to repeated use or on pre-exposure fatigue can be found. Furthermore, JP-A NO. 5-88396 (Patent Document 12) discloses a photoreceptor which includes an undercoat layer containing hydrophobic silica fine particles for the purpose of obtaining satisfactory images.

However, in the photoreceptors which use the above-described materials such as those described in Patent Documents 1 to 12 for the undercoat layer, the resistance of the undercoat layer varies with the changes in temperature and humidity. For that reason, when such photoreceptors are mounted in recent electrophotographic devices where high quality of images is demanded, there is a tendency that it is not easy to simultaneously attain the electric potential characteristics that are stable in all environments ranging from low temperature and low humidity environments to high temperature and high humidity environments, and the image quality in a satisfactory manner.

Furthermore, along with the development of color printers and a rise in the distribution rate thereof in recent years, an increase in the printing speed or a reduction in size or component-count of the device is in progress, so that measures to cope with various use environments are also in demand. Color printers have a tendency that the transfer current increases as a result of transfer with toner color overlap or employment of a transfer belt. Therefore, in the case of performing printing on papers of various sizes, there occurs a difference in the fatigue due to transfer between the areas with paper and the areas without paper, and this causes a failure in which differences in the image density is promoted. That is to say, if printing has been performed more frequently on small-sized paper, in contrast with the part of photoreceptor where paper is present (paper passing area), the part of photoreceptor where paper does not pass (non-paper passing area) is continuously subjected to direct influence of transfer, so that the fatigue due to transfer increases. As a result, when printing is performed on large-sized paper next time, the difference in the fatigue due to transfer between the paper passing area and the non-paper passing area brings on a problem that a potential difference occurs in the developed area, causing a difference in density. This tendency becomes more conspicuous when there is an increase in the transfer current. Furthermore, there are an increasing number of situations in which, when the cover of a printer is opened due to problems such as a paper jam or cartridge exchange, the photoreceptor is left in exposure to light. As a result, there is a density difference even between the light-exposed area and the non-light-exposed area, and thus the problem with the emergence of light-induced fatigue is becoming serious. Under such circumstances, in contrast with monochromatic printers, the demand for reliability in photoreceptors, such as transfer restorability or restorability from intense light-induced fatigue, is markedly increasing particularly in color printers. However, conventional photoreceptors have not been able to meet these demands simultaneously and sufficiently.

Furthermore, in Patent Document 8, there is no description on the investigation on possible application of copolymer resins for which the constituent monomers of the resins or the composition ratios of the monomers are not sufficiently defined. Therefore, although effects are shown in connection with the electric potential characteristics or image quality in high temperature and high humidity environments, the invention cannot be expected to have effects on the potential characteristics that are stable in all environments ranging from low temperature and low humidity environments to high temperature and high humidity environments.

In regard to Patent Document 9, it is the actual situation that sufficient investigations have not been conducted on the restorability from intense light-induced fatigue and restorability from fatigue due to transfer.

Patent Documents 10 and 11 have descriptions that effects on light-induced fatigue due to repeated use, or effects on pre-exposure fatigue can be expected. However, reports on the investigation focusing on the restorability from intense light-induced fatigue and restorability from fatigue due to transfer, and the possibility of achieving a good balance therebetween, are hardly found. That is, photoreceptors that use the undercoat layers that have been hitherto investigated can be put to practical use in monochromatic printers, which do not seem to have problem with the restorability from fatigue due to transfer or with the restorability from light-induced fatigue; however, there is a problem that it is difficult for the photoreceptors to be adapted to color printers where these properties are demanded at a high level. This problem would become more significant, since even color printers also have a tendency that the transfer current increases as the printing speed increases. Particularly, the problem will become more noticeable when the printing speed is 16 ppm (A4, vertical) or greater.

In addition, Patent Document 12 discloses a photoreceptor which includes an undercoat layer containing hydrophobic silica fine particles. Furthermore, a description on a polyester amide resin as the resin for the undercoat layer, is found in paragraph of Patent Document 12. However, in the Patent Document 12, sufficient investigations have not been conducted on the storability from intense light-induced fatigue and the restorability from fatigue due to transfer. Particularly, there is no clear description on whether the effects of the restorability from intense light-induced fatigue and the restorability from fatigue due to transfer can be obtained with all kinds of polyester amide resins.

Thus, the present invention was made in view of the problems described above, and an object of the present invention is to provide an electrophotographic photoreceptor which includes an undercoat layer capable of attaining electric potential characteristics that are stable in all environments ranging from low temperature and low humidity environments to high temperature and high humidity environments, and of suppressing the occurrence of printing defects. Another object of the present invention is to provide an electrophotographic photoreceptor which includes an undercoat layer that is capable of simultaneously attaining the transfer restorability and the restorability from intense light-induced fatigue even in a wide variety of usages and operation environments, and which is consequently capable of printing satisfactory images in which image defects or density differences do not easily occur. Still another object of the present invention is to provide a process for producing the photoreceptor, and an electrophotographic device mounted with the photoreceptor. That is, the present invention is intended to provide an electrophotographic photoreceptor from which sufficient effects can be expected as built-in performances in high speed color printers, a process for producing the photoreceptor, and a color printer mounted with the photoreceptor.

SUMMARY OF THE INVENTION

The inventors of the present invention conducted a thorough investigation in order to solve the problems described above, and as a result, they found that the problems can be solved by using metal oxide fine particles that have been surface-treated with an organic compound in combination with a resin for which the essential constituent monomers and composition ratio of a copolymer resin synthesized using a particular raw material group or raw materials are defined. Thus, the inventors completed the present invention. Particularly, the inventors found that the above-described problems can be solved by using, among various polyester amide resins, a copolymer resin including particular monomers as essential constituent units, thus completing the present invention.

That is, the present invention provides an electrophotographic photoreceptor, comprising: an electroconductive substrate; an undercoat layer provided on the electroconductive substrate and comprised of: metal oxide fine particles including particles of at least one metal oxide and at least one organic compound provided on the particles of the at least one metal oxide as a surface treatment; and a copolymer resin synthesized by copolymerization of essential constituent monomers comprised of a dicarboxylic acid, a diol, a triol and a diamine; and a photosensitive layer laminated on the undercoat layer.

Furthermore, the electrophotographic photoreceptor of the present invention is suitably such that when the copolymerization ratio of the dicarboxylic acid is designated as a (mol %), the copolymerization ratio of the diol is designated as b (mol %), the copolymerization ratio of the triol is designated as c (mol %)< and the copolymerization ratio of the diamine is designated as d (mol %), a, b, c and d satisfy expression (1) as follows:

$$-10<a-(b+c+d)<10 \quad (1).$$

The electrophotographic photoreceptor of the present invention is suitably such that the dicarboxylic acid includes at least one of an aromatic dicarboxylic acid and an aliphatic dicarboxylic acid, and when the copolymerization ratio of the aromatic dicarboxylic acid is designated as a1 (mol %), and the copolymerization ratio of the aliphatic dicarboxylic acid as a2 (mol %), a in the above expression (1) is: a=a1+a2.

Furthermore, according to the present invention, it is suitable that a1 ranges from 23 to 39 mol %, a2 ranges from 11 to 27 mol %, b ranges from 21 to 37 mol %, c ranges from 6 to 22 mol %, and d ranges from 0.01 to 15 mol %.

It is suitable that in the undercoat layer, the aromatic dicarboxylic acid is selected to be isophthalic acid, or the aliphatic dicarboxylic acid is selected to be adipic acid. Furthermore, it is also suitable that the aromatic dicarboxylic acid is selected to be isophthalic acid, and the aliphatic dicarboxylic acid is selected to be adipic acid.

According to the present invention, it is suitable that the diol is selected to be neopentyl glycol.

Furthermore, according to the present invention, it is suitable that the triol is selected to be trimethylolpropane.

Furthermore, according to the present invention, it is suitable that the diamine is selected to be benzoguanamine.

According to the present invention, it is suitable that a copolymer resin synthesized using isophthalic acid and/or adipic acid as the dicarboxylic acid, neopentyl glycol as the diol, trimethylolpropane as the triol, and benzoguanamine as the diamine, is used as the undercoat layer.

Furthermore, according to the present invention, it is suitable that the particles of at least one metal oxide are selected from the group consisting of titanium oxide, tin oxide, zinc oxide and copper oxide. Furthermore, it is suitable that the at least one organic compound is selected from the group consisting of a siloxane compound, an alkoxysilane compound and a silane coupling agent.

According to the present invention, it is suitable that the undercoat layer contains a melamine resin.

Furthermore, according to the present invention, it is suitable that the photosensitive layer comprises at least one binder selected from the group consisting of a polycarbonate resin, a polyester resin, a polyamide resin, a polyurethane resin, a vinyl chloride resin, a vinyl acetate resin, a phenoxy resin, a polyvinyl acetal resin, a polyvinyl butyral resin, a polystyrene resin, a polysulfone resin, a diallyl phthalate resin, and a methacrylic acid ester resin.

The process for producing an electrophotographic photoreceptor of the present invention is a process for producing the electrophotographic photoreceptor described above, and the process is characterized by including preparing a coating liquid for said undercoat layer comprised of metal oxide fine particles including particles of at least one metal oxide and at least one organic compound provided on the particles of the at least one metal oxide as a surface treatment, and a copolymer resin synthesized by copolymerization of essential constituent monomers comprised of a dicarboxylic acid, a diol, a triol and a diamine; and applying the coating liquid on said electroconductive substrate to form said undercoat layer.

The electrophotographic device of the present invention comprises the above-described electrophotographic photoreceptor mounted therein.

The tandem color electrophotographic device of the present invention comprises the above-described electrophotographic photoreceptor mounted therein.

According to the present invention, there is provided an electrophotographic photoreceptor which has electric potential characteristics that are stable in all environments ranging from low temperature and low humidity environments to high temperature and high humidity environments, and includes an undercoat layer that does not easily generate printing defects. Furthermore, there is provided an electrophotographic photoreceptor which includes an undercoat layer capable of simultaneously attaining the transfer restorability and the restorability from intense light-induced fatigue even in a wide variety of usages and operation environments, and which is consequently capable of printing satisfactory images in which image defects or density differences do not easily occur. In addition, a process for producing the photoreceptor, and an electrophotographic photoreceptor mounted with the photoreceptor can be provided.

DETAILED DESCRIPTION OF THE INVENTION

Hereinafter, specific embodiments of the electrophotographic photoreceptor according to the present invention will be described in detail with reference to attached drawings. This invention is not intended to be limited to the embodiments that will be described below.

Figure 1:
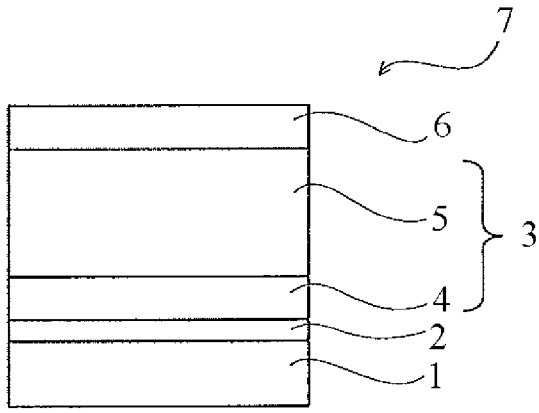
FIG. 1 is a schematic cross-sectional view showing a configuration example of a negatively charged, functionally separated laminated type electrophotographic photoreceptor related to the present invention.

Electrophotographic photoreceptors include both negatively charged laminated type photoreceptors and positively charged single layer type photoreceptors, but in this embodiment, a schematic cross-sectional view of a negatively charged laminated type electrophotographic photoreceptor is presented in FIG. 1 as an example. As depicted in the diagram, when the electrophotographic photoreceptor 7 of the present invention is a negatively charged laminated type photoreceptor, the electrophotographic photoreceptor has an undercoat layer 2, and a photosensitive layer 3 composed of a charge generation layer 4 having a charge generation function, and a charge transport layer 5 having a charge transport function, sequentially laminated on an electroconductive substrate 1. Furthermore, both types of the photoreceptors 7 may further have a surface protective layer 6 provided on the photosensitive layer 3.

The electroconductive substrate 1 has a role as an electrode, and at the same time, serves as a support for the various layers constituting the photoreceptor 7. The shape may be any of a cylindrical shape, a plate shape, a film shape and the like, and the material may be any of metals such as aluminum, stainless steel and nickel, and products prepared by electroconductively treating the surfaces of glass, resins and the like.

The undercoat layer 2 is formed from a layer containing a copolymer resin as a main component, and is installed in order to control the injection of charges from the electroconductive substrate 1 to the photosensitive layer 3, or for the purposes of covering defects on the surface of the electroconductive substrate 1, enhancing the adhesiveness between the photosensitive layer 3 and the undercoat, and the like. The details of the undercoat layer 2 will be described later.

The charge generation layer 4 is formed by a method of applying a coating liquid in which particles of a charge generating material are dispersed in a resin binder as described above, or the like, and generates charges by receiving light. Furthermore, high charge generation efficiency of the charge generation layer as well as the injectability of generated charges to the charge transport layer 5 are important, and it is desirable that the charge generation layer has less electric field dependency, and injection is satisfactorily achieved even in low electric fields. Examples of the charge generating material include phthalocyanine compounds such as X type metal-free phthalocyanine, τ type metal-free phthalocyanine, α type titanyl phthalocyanine, β type titanyl phthalocyanine, Y type titanyl phthalocyanine, γ type titanyl phthalocyanine, amorphous type titanyl phthalocyanine, and ϵ type copper phthalocyanine; various azo pigments, anthanthrone pigments, thiapyrylium pigments, perylene pigments, perinone pigments, squarylium pigments, and quinacridone pigments, and these are used singly or in appropriate combinations. Thus, a suitable material can be selected in accordance with the light wavelength region of the exposure light source that is used in the formation of images.

Since it is desirable for the charge generation layer 4 to have a charge generation function, the film thickness is determined by the coefficient of light absorption of the charge generating material, and is generally 1 μm or less, and suitably 0.5 μm or less. The charge generation layer 4 can also use a charge generating material as a main component and have a charge transporting material or the like added thereto. For the resin binder, polymers and copolymers of a polycarbonate resin, a polyester resin, a polyamide resin, a polyurethane resin, a vinyl chloride resin, a vinyl acetate resin, a phenoxy resin, a polyvinyl acetal resin, a polyvinyl butyral resin, a polystyrene resin, a polysulfone resin, a diallyl phthalate resin and a methacrylic acid ester resin can be used in appropriate combination.

The charge transport layer 5 is mainly composed of a charge transporting material and a resin binder, and examples of the charge transporting material that is used include various hydrazone compounds, styryl compounds, diamine compounds, butadiene compounds, and indole compounds, while these materials are used singly or as mixtures of appropriate combination. Examples of the resin binder include polycarbonate resins such as bisphenol A type, bisphenol Z type, and bisphenol A type biphenyl copolymers; polystyrene resins, and polyphenylene resins, and these resins are used singly, or as mixtures of appropriate combination. The amount of use of such a compound is 2 to 50 parts by mass, suitably 3 to 30 parts by mass, of the charge transporting material relative to 100 parts by mass of the resin binder. The thickness of the charge transport layer is preferably in the range of 3 to 50 μm, and more suitably 15 to 40 μm, in order to maintain a practically effective surface potential.

In the undercoat layer 2, charge generation layer 4, and charge transport layer 5, various additives are used according to necessity for the purposes of an enhancement of sensitivity, a decrease in residual potential, an enhancement of resistance to environment or stability against harmful light, an enhancement of high durability including friction resistance, and the like. Examples of the additives that can be used include compounds such as succinic anhydride, maleic anhydride, dibromosuccinic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, and trinitrofluorenone. Furthermore, an oxidation inhibitor, a photostabilizer and the like can also be added. Examples of the compounds used for such purposes include, but are not limited to, chromal derivatives such as tocopherol, as well as ether compounds, ester compounds, polyarylalkane compounds, hydroquinone derivatives, diether compounds, benzophenone derivatives, benzotriazole derivatives, thioether compounds, phenylenediamine derivatives, phosphonic acid esters, phosphorous acid esters, phenol compounds, hindered phenol compounds, linear amine compounds, cyclic amine compounds, and hindered amine compounds.

Furthermore, a leveling agent such as a silicone oil or a fluorine-based oil can also be incorporated into the photosensitive layer 3, for the purpose of enhancing the leveling property of the film formed or imparting further lubricity.

The photosensitive layer 3 may be further provided on the surface with a surface protective layer 6 as necessary, for the purpose of further enhancing environment resistance or mechanical strength. The surface protective layer 6 is desirably constituted of a material which is excellent in durability to mechanical stresses and environment resistance, so that the layer has a function of transmitting the light to which the charge generation layer 4 responds, at a loss as small as possible.

The surface protective layer 6 is formed from a layer which contains a resin binder as a main component, or from an inorganic thin film of amorphous carbon or the like. Furthermore, for the purposes of an enhancement of electroconductivity, lowering of the friction coefficient, impartation of lubricity and the like, the resin binder may contain a metal oxide such as silicon oxide (silica), titanium oxide, zinc oxide, calcium oxide, aluminum oxide (alumina), or zirconium oxide; a metal sulfide such as barium sulfate or calcium sulfate; a metal nitride such as silicon nitride or aluminum nitride; fine particles of a metal oxide; or particles of a fluorine-based resin such as a tetrafluoroethylene resin, or a fluorine-based comb-like graft polymer resin. A charge transporting material that is used in the photosensitive layer 3 or an electron accepting material may be incorporated into the surface protective layer 6 for the purpose of imparting charge transportability, or a leveling agent such as a silicone oil or a fluorine-based oil may also be incorporated into the surface protective layer for the purpose of enhancing the leveling property of the film thus formed or imparting lubricity. The thickness of the surface protective layer 6 itself is dependent on the blend composition of the surface protective layer 6, but can be arbitrarily determined within the scope that adverse effects such as an increase in the residual potential during a repeated continuous use of the photoreceptor are not exhibited.

The electrophotographic photoreceptor 7 of the present invention may yield expected effects when applied to various machine processes. Specifically, sufficient effects are obtained with the electrophotographic photoreceptor in the electrification processes of contact charging systems using a roller or a brush, and non-contact charging systems using a corotron, a scorotron or the like; and in the development processes of contact development systems and non-contact development systems which use non-magnetic one-component, magnetic one-component, and two-component development systems, and the like.

Figure 2:
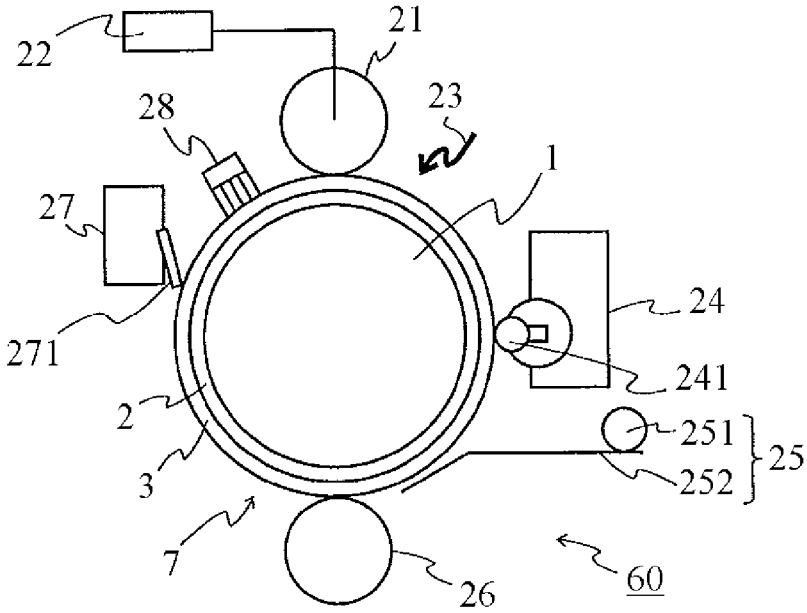
FIG. 2 is a schematic configuration diagram of an electrophotographic device according to the present invention.

As an example, FIG. 2 shows a schematic configuration diagram of an electrophotographic device according to the present invention. The electrophotographic device 60 of the present invention is mounted with the electrophotographic photoreceptor 7 of the present invention, which includes an electroconductive substrate 1, and an undercoat layer 2 and a photosensitive layer 3 coated on the peripheral surfaces of the electroconductive substrate. Furthermore, this electrophotographic device 60 is constituted of a roller charging member 21 that is disposed around the outer periphery of the photoreceptor 7; a high voltage power supply 22 which supplies an applied voltage to the roller charging member 21; an image exposure member 23; a developing machine 24 equipped with a developing roller 241; a paper supply member 25 equipped with a paper supply roller 251 and a paper supply guide 252; a transfer charger (direct charging type) 26; a cleaning device 27 equipped with a cleaning blade 271; and a charge eliminating member 28. In addition, the electrophotographic device 60 of the present invention is such that there are no limitations on the configuration other than the electrophotographic photoreceptor 7 of the present invention, and the electrophotographic device can have the configuration of an already known electrophotographic device, particularly of a tandem color electrophotographic device.

According to the present invention, it is required that the undercoat layer 2 contain metal oxide fine particles that are surface treated with an organic compound, and a copolymer resin synthesized using a dicarboxylic acid, a diol, a triol and a diamine as constituent monomers.

According to the present invention, it is preferable that when the copolymerization ratio of the dicarboxylic acid is designated as a (mol %), the copolymerization ratio of the diol as b (mol %), the copolymerization ratio of the triol as c (mol %), and the copolymerization ratio of the diamine as d (mol %), a, b, c and d satisfy the following expression (1):

$$-10<a-(b+c+d)<10 \quad (1).$$

Furthermore, a+b+c+d is preferably in the range of 61.01 mol % to 100 mol %, and more suitably 90 mol % to 100 mol %, relative to the total amount of the constituent monomers.

Furthermore, according to the present invention, it is more preferable that the dicarboxylic acid include any one or both of an aromatic dicarboxylic acid and an aliphatic dicarboxylic acid. Here, when the copolymerization ratio of the aromatic dicarboxylic acid is designated as a1 (mol %) and the copolymerization ratio of the aliphatic dicarboxylic acid as a2 (mol %), a in the above expression (1) is in the relation: a=a1+a2. Also, when the dicarboxylic acid includes an aromatic dicarboxylic acid and an aliphatic dicarboxylic acid, a1+a2+b+c+d is preferably in the range of 61.01 mol % to 100 mol %, and more suitably 90 mol % to 100 mol %, relative to the total amount of the constituent monomers.

In addition, according to the present invention, it is even more preferable that a1, a2, b, c and d satisfy the range of 23 to 39, the range of 11 to 27, the range of 21 to 37, the range of 6 to 22, and the range of 0.01 to 15, respectively. When the values are in these ranges, the solubility of the copolymer resin in a solvent is improved so that more choices are allowed for the solvent to be used, or obvious superiority in dispersion stability can be seen. It is particularly preferable that a1, a2, b, c and d satisfy the range of 27 to 34, the range of 15 to 23, the range of 25 to 33, the range of 10 to 18, and the range of 4 to 11, respectively. When the values are in these ranges, the uniformity in film thickness or the external appearance of the coating film is further improved.

Examples of the resin that may be used in the undercoat layer 2 include an acrylic resin, a vinyl acetate resin, a polyvinyl formal resin, a polyurethane resin, a polyamide resin, a polyester resin, an epoxy resin, a melamine resin, a polybutyral resin, a polyvinyl acetal resin, and a vinylphenol resin, and these resins can be used singly, or as mixtures of appropriate combination. Among them, combinations with a melamine resin are more preferred.

According to the present invention, there are no particular limitations on the dicarboxylic acid, but as explained above, it is preferable that the dicarboxylic acid include an aromatic dicarboxylic acid and an aliphatic dicarboxylic acid. An example of the aromatic dicarboxylic acid may be isophthalic acid, and an example of the aliphatic dicarboxylic acid may be adipic acid.

According to the present invention, there are no particular limitations on the diol, but an example thereof may be neopentyl glycol.

According to the present invention, there are no particular limitations on the triol, but an example thereof may be trimethylolpropane.

According to the present invention, there are no particular limitations on the diamine, but an example thereof may be benzoguanamine.

Furthermore, according to the present invention, examples of the metal oxide fine particles that can be used include fine particles of titanium oxide, tin oxide, zinc oxide and copper oxide, and these may be surface treated with an organic compound such as a siloxane compound, an alkoxysilane compound or a silane coupling agent.

The process for producing the electrophotographic photoreceptor 7 of the present invention includes a step of preparing a coating liquid for undercoat layer containing metal oxide fine particles that have been surface treated with an organic compound, and a copolymer resin synthesized using a dicarboxylic acid, a diol, a triol and a diamine as essential constituent monomers; and a step of applying the coating liquid on an electroconductive substrate 1 to form an undercoat layer 2. For example, a negatively charged type photoreceptor 7 can be produced by forming an undercoat layer 2, which is formed by immersion coating with the above-described coating liquid, on an electroconductive substrate 1; forming thereon a charge generation layer 4 by immersion coating with a coating liquid in which a charge generating material such as described above is dispersed in a resin binder; and laminating a charge transport layer 5 that is formed by immersion coating with a coating liquid in which a charge transporting material such as described above is dispersed or dissolved in a resin binder.

Furthermore, the coating liquids according to the production process of the present invention can be applied by various coating methods such as an immersion coating method and a spray coating method, and can be applied without being limited to any particular coating method.

EXAMPLES

Hereinafter, the present invention will be described by way of Examples, but the embodiments of the present invention are not intended to be limited to the following Examples.

Example 1

Figure 3:
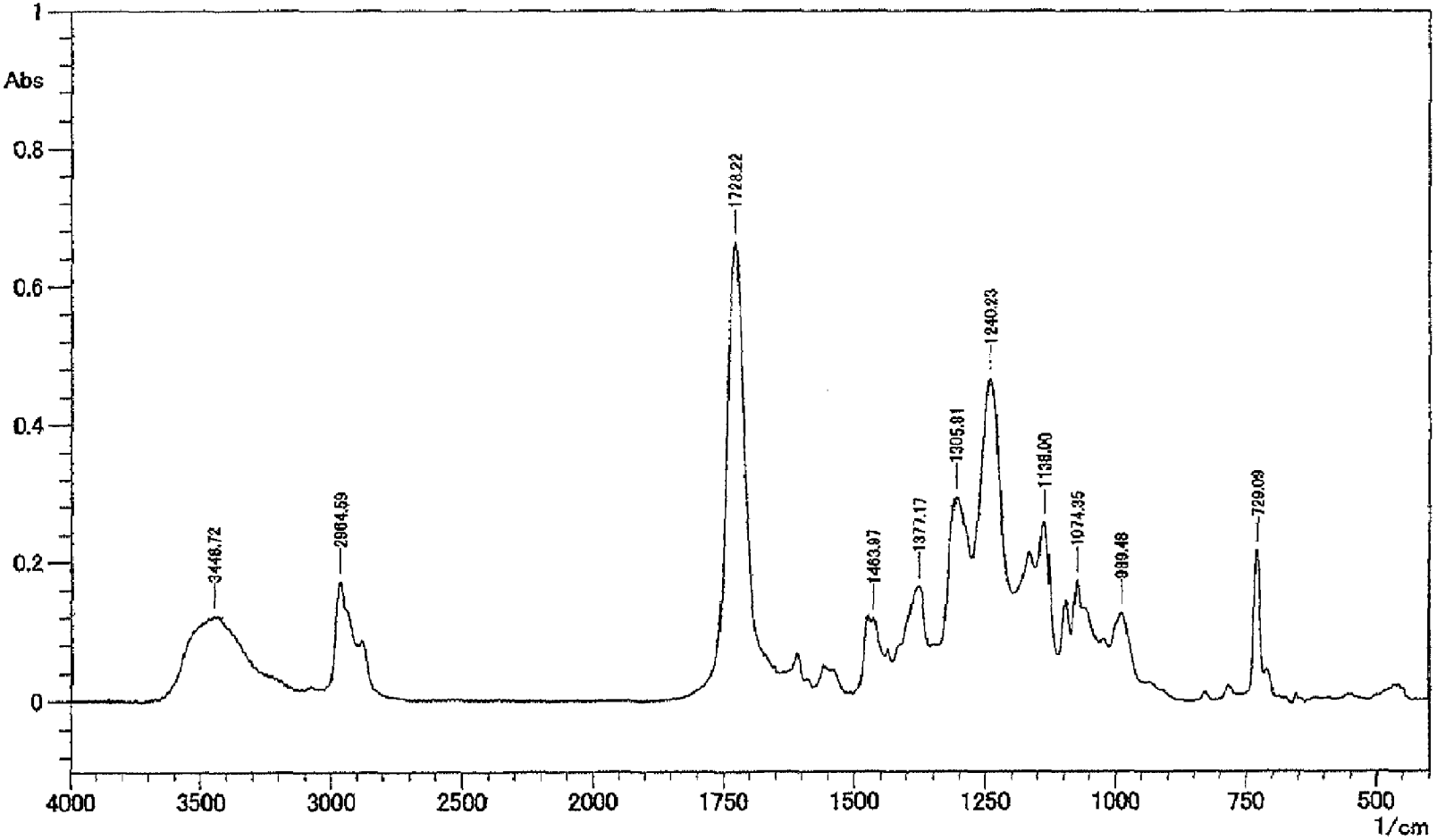
FIG. 3 is a graph showing an IR spectrum of a resin.
Figure 4:
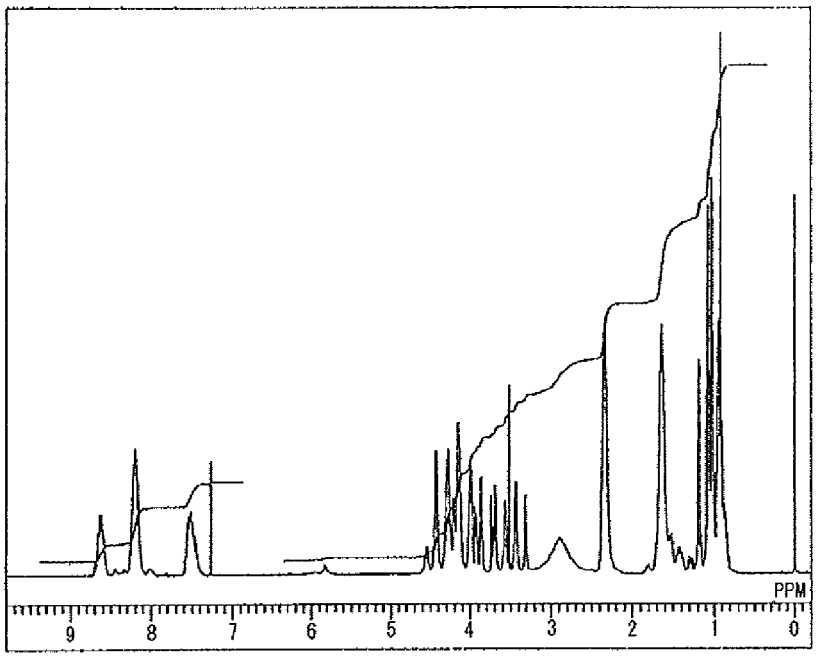
FIG. 4 is a graph showing a $^{1}$H-NMR spectrum of a resin.

Preparation of Copolymer Resin 31 mol % of isophthalic acid, 19 mol % of adipic acid, 29 mol % of neopentyl glycol, 14 mol % of trimethylolpropane, and 7 mol % of benzoguanamine were mixed to obtain a total amount of 150 g in a 300-mL four-necked flask. The temperature was raised to 130° C. while nitrogen was blown into the reaction system. After the reaction system was maintained for one hour, the temperature was raised to 200° C., and the reaction of polymerization was further carried out to obtain a resin. The IR spectrum of the resin thus obtained is presented in FIG. 3. Also, the $^{1}$H-NMR spectrum of the resin thus obtained is presented in FIG. 4.

Undercoat Layer:

100 parts by mass of a total resin liquid which was prepared by mixing the resin thus obtained and a melamine resin (Uvan 2021 resin liquid, manufactured by Mitsui Chemicals, Inc.) at a mixing ratio of 4:1, was dissolved in a solvent composed of 2000 parts by mass of methyl ethyl ketone. 400 parts by mass of an alkoxysilane-treated product of microparticulate titanium oxide (JMT150) manufactured by Tayca Corporation, which are metal oxide fine particles, was added to the solution obtained above, and thus a slurry was produced. This slurry was subjected to a dispersion treatment for 20 passes, using a disk type bead mill charged with zirconia beads having a bead diameter of 0.3 mm at a volume packing ratio of 70 v/v % based on the vessel volume, at a treatment liquid flow rate of 400 mL/min and a disk peripheral speed of 3 m/s, and thus a coating liquid for undercoat layer was obtained.

An undercoat layer 2 was formed on a cylindrical Al base (electroconductive substrate) 1 by immersion coating using the coating liquid for undercoat layer thus prepared. The undercoat layer 2 obtained by drying the coating liquid under the conditions of a drying temperature of 135° C. and a drying time of 10 minutes, had a thickness after drying of 3 μm.

Charge Generation Layer:

Subsequently, 1 part by mass of a vinyl chloride-based copolymer resin (MR110, manufactured by Zeon Corporation, Japan) as a resin was dissolved in 98 parts by mass of dichloromethane, and 2 parts by mass of a type titanyl phthalocyanine (described in JP-A No. 61-217050 or U.S. Pat. No. 4,728,5592) as a charge generating material was added to the solution. Thus, slurry was prepared. 5 L of this slurry was subjected to a dispersion treatment for 10 passes, using a disk type bead mill charged with zirconia beads having a bead diameter of 0.4 mm at a volume packing ratio of 85 v/v % based on the vessel volume, at a treatment liquid flow rate of 300 mL/min and a disk peripheral speed of 3 m/s, and thus a coating liquid for charge generation layer was prepared.

A charge generation layer 4 was formed on the electroconductive substrate 1 on which the undercoat layer 2 had been applied, using the coating liquid for charge generation layer thus obtained. The charge generation layer 4 obtained by drying the coating liquid under the conditions of a drying temperature of 80° C. and a drying time of 30 minutes, had a thickness after drying of 0.1 to 0.5 μm.

Charge Transport Layer:

Subsequently, a coating liquid for charge transport layer was prepared by dissolving 5 parts by mass of a compound represented by the following structural formula (1) and 5 parts by mass of a compound represented by the following structural formula (2) as charge transporting agents, and 10 parts by mass of a bisphenol Z type polycarbonate resin (TS2050, manufactured by Teijin Kasei, Inc.) as a binding resin, in 70 parts by mass of dichloromethane. This coating liquid was applied on the charge generation layer 4 by immersion coating and was dried at a temperature of 90° C. for 60 minutes. Thus, a charge transport layer 5 having a thickness of 25 μm was formed. As such, an electrophotographic photoreceptor 7 was produced.

(1)

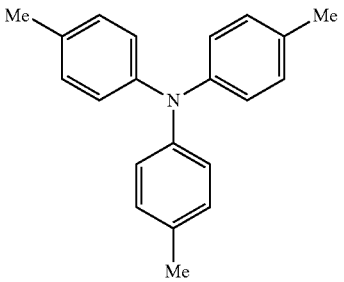

-continued (2)

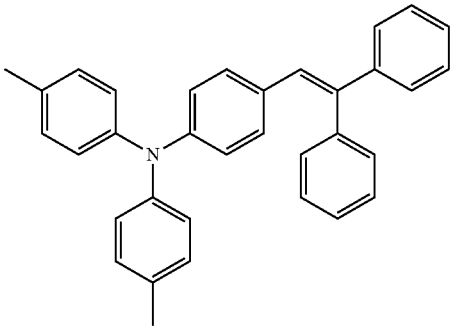

Example 2

28 mol % of isophthalic acid, 20.5 mol % of adipic acid, 32 mol % of neopentyl glycol, 15.5 mol % of trimethylolpropane, and 4 mol % of benzoguanamine were mixed, and the mixture was polymerized under heating to obtain a resin. The resin thus obtained was used in the same manner as in Example 1 to prepare a coating liquid for undercoat layer, and thus a photoreceptor 7 was produced.

Example 3

32 mol % of isophthalic acid, 20 mol % of adipic acid, 27.9 mol % of neopentyl glycol, 19.1 mol % of trimethylolpropane, and 1 mol % of benzoguanamine were mixed, and the mixture was polymerized under heating to obtain a resin. The resin thus obtained was used in the same manner as in Example 1 to prepare a coating liquid for undercoat layer, and thus a photoreceptor 7 was produced.

Example 4

23 mol % of isophthalic acid, 24.6 mol % of adipic acid, 36 mol % of neopentyl glycol, 14 mol % of trimethylolpropane, and 2.4 mol % of benzoguanamine were mixed, and the mixture was polymerized under heating to obtain a resin. The resin thus obtained was used in the same manner as in Example 1 to prepare a coating liquid for undercoat layer, and thus a photoreceptor 7 was produced.

Example 5

34 mol % of isophthalic acid, 20.6 mol % of adipic acid, 26 mol % of neopentyl glycol, 15.7 mol % of trimethylolpropane, and 3.7 mol % of benzoguanamine were mixed, and the mixture was polymerized under heating to obtain a resin. The resin thus obtained was used in the same manner as in Example 1 to prepare a coating liquid for undercoat layer, and thus a photoreceptor 7 was produced.

Example 6

25 mol % of isophthalic acid, 20.5 mol % of adipic acid, 36 mol % of neopentyl glycol, 15 mol % of trimethylolpropane, and 3.5 mol % of benzoguanamine were mixed, and the mixture was polymerized under heating to obtain a resin. The resin thus obtained was used in the same manner as in Example 1 to prepare a coating liquid for undercoat layer, and thus a photoreceptor 7 was produced.

Example 7

30 mol % of isophthalic acid, 25.5 mol % of adipic acid, 30 mol % of neopentyl glycol, 10.5 mol % of trimethylolpropane, and 4 mol % of benzoguanamine were mixed, and the mixture was polymerized under heating to obtain a resin. The resin thus obtained was used in the same manner as in Example 1 to prepare a coating liquid for undercoat layer, and thus a photoreceptor 7 was produced.

Example 8

26.5 mol % of isophthalic acid, 17 mol % of adipic acid, 35 mol % of neopentyl glycol, 17.5 mol % of trimethylolpropane, and 4 mol % of benzoguanamine were mixed, and the mixture was polymerized under heating to obtain a resin. The resin thus obtained was used in the same manner as in Example 1 to prepare a coating liquid for undercoat layer, and thus a photoreceptor 7 was produced.

Comparative Example 1

26 mol % of isophthalic acid, 20 mol % of adipic acid, 51.3 mol % of trimethylolpropane, and 2.7 mol % of benzoguanamine were mixed, and the mixture was polymerized under heating to obtain a resin. The resin thus obtained was used in the same manner as in Example 1 to prepare a coating liquid for undercoat layer, and thus a photoreceptor was produced.

Comparative Example 2

26 mol % of isophthalic acid, 20 mol % of adipic acid, 51.3 mol % of neopentyl glycol, and 2.7 mol % of benzoguanamine were mixed, and the mixture was polymerized under heating to obtain a resin. The resin thus obtained was used in the same manner as in Example 1 to prepare a coating liquid for undercoat layer, and thus a photoreceptor was produced.

Comparative Example 3

28 mol % of isophthalic acid, 20.5 mol % of adipic acid, 36 mol % of neopentyl glycol, and 15.5 mol % of trimethylolpropane were mixed, and the mixture was polymerized under heating to obtain a resin. The resin thus obtained was used in the same manner as in Example 1 to prepare a coating liquid for undercoat layer, and thus a photoreceptor was produced.

Examples 9 to 16

Photoreceptors 7 were produced in the same manner as in Examples 1 to 8, respectively, except that the charge transporting agents described in Example 1 were replaced with 10 parts by mass of a compound represented by the following structural formula (3).

(3)

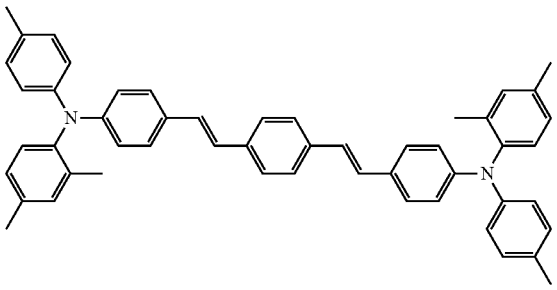

Comparative Examples 4 to 6

Photoreceptors were produced in the same manner as in Comparative Examples 1 to 3, respectively, except that the charge transporting agents described in Example 1 were replaced with 10 parts by mass of a compound represented by the following structural formula (3).

Examples 17 to 24

Photoreceptors 7 were produced in the same manner as in Examples 1 to 8, respectively, except that the resin in the coating liquid for charge generation layer described in Example 1 was replaced with a polyvinyl butyral resin (S-LEC B BX-1, manufactured by Sekisui Chemical Co., Ltd.).

Comparative Examples 7 to 9

Photoreceptors were produced in the same manner as in Comparative Examples 1 to 3, respectively, except that the resin in the coating liquid for charge generation layer described in Example 1 was replaced with a polyvinyl butyral resin (S-LEC B BX-1, manufactured by Sekisui Chemical Co., Ltd.).

Examples 25 to 32

Photoreceptors 7 were produced in the same manner as in Examples 1 to 8, respectively, except that the charge transporting agents described in Example 1 were replaced with 10 parts by mass of the compound represented by the structural formula (3), and the resin in the coating liquid for charge generation layer described in Example 1 was replaced with a polyvinyl butyral resin (S-LEC B BX-1, manufactured by Sekisui Chemical Co., Ltd.).

Comparative Examples 10 to 12

Photoreceptors were produced in the same manner as in Comparative Examples 1 to 3, respectively, except that the charge transporting agents described in Example 1 were replaced with 10 parts by mass of the compound represented by the structural formula (3), and the resin in the coating liquid for charge generation layer described in Example 1 was replaced with a polyvinyl butyral resin (S-LEC B BX-1, manufactured by Sekisui Chemical Co., Ltd.).

Each of the photoreceptors obtained in Examples 1 to 32 and Comparative Examples 1 to 12 was installed in a commercially available tandem color printer (C5800, 26 ppm A4 vertical, manufactured by Oki Data Corporation), and 3 sheets of white solid images and 3 sheets of black solid images were printed in the following environments: LL environment: 10° C., 15% RH; NN environment: 25° C., 50% RH; and HH environment: 35° C., 85% RH. Subsequently, the electric potential after exposure and the image quality were evaluated.

The electric potential evaluation was carried out by determining the good or bad based on the amount of variation in potential after exposure under various environments (difference between the electric potential after exposure in the LL environment and the electric potential after exposure in the HH environment). In the evaluation of image data, the good or bad was determined based on the background fogging in the white areas of an image, and the presence or absence of black dots, according to the following criteria: ◎ : Very good; ○: Good; Δ: Black dots are present; and x: Background fogging and black dots are present. The results are presented in the following Tables 1 to 4.

Figure 5:
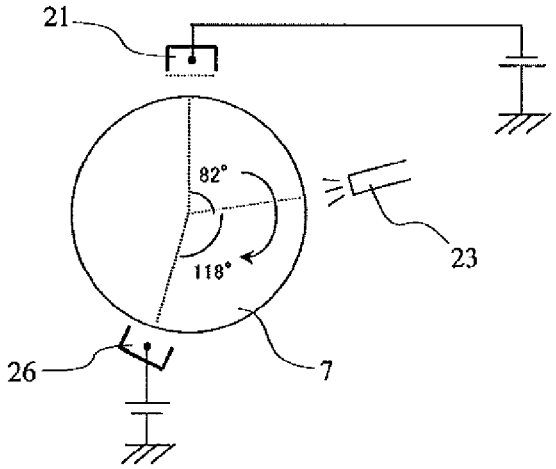
FIG. 5 is a schematic diagram of a simulator used in an evaluation of the electrophotographic photoreceptor.

In the evaluation of the restorability from fatigue due to transfer, the restorability from fatigue due to transfer was evaluated in printed images produced by a commercially available tandem color printer (C5800n, 26 ppm A4 vertical, manufactured by Oki Data Corporation), using a process simulator (CYNTHIA 91) manufactured by Gen-Tech, Inc. as a transfer fatigue unit. In regard to the simulator, the arrangement of the electrophotographic device shown in FIG. 5 was employed, and an image exposure member 23 (exposure light source, optical interference filter+halogen lamp) was irradiated under the conditions of 780-nm monochromatic light at 0.4 $\mu J/cm^2$, with the settings of a peripheral speed of the photoreceptor 7 of 60 rpm, a charging voltage of −5 kV, a grid voltage of 650 V, and a transfer voltage of +5 kV. Thus, the photoreceptor was subjected to repeated fatigue for 5 minutes by changing the on-off of exposure for every 5 rotations of the drum (300 rotations in total). Subsequently, the fatigued photoreceptor 7 was mounted on the printer, and the density differences between the fatigued area and non-fatigued area of images that were printed immediately after the fatigue, after one hour of dark adaptation, and after 3 hours of dark adaptation, respectively, were measured with an image density analyzer (RD918, manufactured by Macbeth, Inc.). Thus, the restorability from fatigue due to transfer from the time point immediately after fatigue was determined by the following criteria: ◎ : Restorability from fatigue due to transfer is very good; ○: Restorability from fatigue due to transfer is good; Δ: Restorability from fatigue due to transfer is slightly problematic; and x: Restorability from fatigue due to transfer is problematic. The results are presented in the following Tables 3 and 4.

In the evaluation of the restorability from intense light-induced fatigue, the restorability from fatigue was evaluated with printed images produced by a commercially available tandem color printer (C5800n, 26 ppm A4 vertical, manufactured by Oki Data Corporation), by leaving the printed images in exposure to light using a fluorescent lamp as an intense light-induced fatigue unit. The intense light-induced fatigue test was carried out by covering the photoreceptor 7 with a carbon paper (240 mm in length×150 mm in width) in which a window having a size of 20 mm×50 mm was cut out at the center, and leaving the photoreceptor in exposure to light for 30 minutes, with the window facing upward, under a commercially available white fluorescent lamp (manufactured by Hitachi, Ltd.) which was positioned so as to obtain a light amount of 1000 Lx. Subsequently, the photoreceptor was mounted on the printer, and half-tone images were printed immediately after exposure and after one hour of dark adaptation. The density differences between the light-fatigued area and the non-light-fatigued area of the respective images were measured with an image density analyzer (RD918, manufactured by Macbeth, Inc.). Thus, the restorability from intense light-induced fatigue was determined by the following criteria: ◎ : Restorability from intense light-induced fatigue is very good; ○: Restorability from intense light-induced fatigue is good; Δ: Restorability from intense light-induced fatigue is slightly problematic; and x: Restorability from intense light-induced fatigue is problematic. The results are presented in the following Tables 3 and 4.

TABLE 1

| | Aromatic dicarboxylic acid a1 | Aliphatic dicarboxylic acid a2 | Diol b | Triol c | Diamine d | Copolymerization ratio a − (b + c + d) | Amount of variation in potential after LL-HH exposure, ΔV |
|---|---|---|---|---|---|---|---|
| Example 1 | 31 | 19 | 29 | 14 | 7 | 0.0 | 16 |
| Example 2 | 28 | 20.5 | 32 | 15.5 | 4 | −3.0 | 17 |
| Example 3 | 32 | 20 | 27.9 | 19.1 | 1 | 4.0 | 19 |
| Example 4 | 23 | 24.6 | 36 | 14 | 2.4 | −4.8 | 20 |
| Example 5 | 34 | 20.6 | 26 | 15.7 | 3.7 | 9.2 | 27 |
| Example 6 | 25 | 20.5 | 36 | 15 | 3.5 | −9.0 | 26 |
| Example 7 | 30 | 25.5 | 30 | 10.5 | 4 | 11.0 | 36 |
| Example 8 | 26.5 | 17 | 35 | 17.5 | 4 | −13.0 | 39 |
| Comparative Example 1 | 26 | 20 | 0 | 51.3 | 2.7 | −8.0 | 56 |
| Comparative Example 2 | 26 | 20 | 51.3 | 0 | 2.7 | −8.0 | 58 |
| Comparative Example 3 | 28 | 20.5 | 36 | 15.5 | 0 | −3.0 | 63 |
| Example 9 | 31 | 19 | 29 | 14 | 7 | 0.0 | 11 |
| Example 10 | 28 | 20.5 | 32 | 15.5 | 4 | −3.0 | 13 |
| Example 11 | 32 | 20 | 27.9 | 19.1 | 1 | 4.0 | 15 |
| Example 12 | 23 | 24.6 | 36 | 14 | 2.4 | −4.8 | 14 |
| Example 13 | 34 | 20.6 | 26 | 15.7 | 3.7 | 9.2 | 26 |
| Example 14 | 25 | 20.5 | 36 | 15 | 3.5 | −9.0 | 25 |
| Example 15 | 30 | 25.5 | 30 | 10.5 | 4 | 11.0 | 35 |
| Example 16 | 26.5 | 17 | 35 | 17.5 | 4 | −13.0 | 38 |
| Comparative Example 4 | 26 | 20 | 0 | 51.3 | 2.7 | −8.0 | 54 |
| Comparative Example 5 | 26 | 20 | 51.3 | 0 | 2.7 | −8.0 | 55 |
| Comparative Example 6 | 28 | 20.5 | 36 | 15.5 | 0 | −3.0 | 61 |

TABLE 2

| | Aromatic dicarboxylic acid a1 | Aliphatic dicarboxylic acid a2 | Diol B | Triol C | Diamine D | a − (b + c + d) | Amount of variation in potential after LL-HH exposure, ΔV |
|---|---|---|---|---|---|---|---|
| Example 17 | 31 | 19 | 29 | 14 | 7 | 0.0 | 16 |
| Example 18 | 28 | 20.5 | 32 | 15.5 | 4 | −3.0 | 16 |
| Example 19 | 32 | 20 | 27.9 | 19.1 | 1 | 4.0 | 19 |
| Example 20 | 23 | 24.6 | 36 | 14 | 2.4 | −4.8 | 18 |
| Example 21 | 34 | 20.6 | 26 | 15.7 | 3.7 | 9.2 | 28 |
| Example 22 | 25 | 20.5 | 36 | 15 | 3.5 | −9.0 | 27 |
| Example 23 | 30 | 25.5 | 30 | 10.5 | 4 | 11.0 | 37 |
| Example 24 | 26.5 | 17 | 35 | 17.5 | 4 | −13.0 | 38 |
| Comparative Example 7 | 26 | 20 | 0 | 51.3 | 2.7 | −8.0 | 58 |
| Comparative Example 8 | 26 | 20 | 51.3 | 0 | 2.7 | −8.0 | 60 |
| Comparative Example 9 | 28 | 20.5 | 36 | 15.5 | 0 | −3.0 | 66 |
| Example 25 | 31 | 19 | 29 | 14 | 7 | 0.0 | 12 |
| Example 26 | 28 | 20.5 | 32 | 15.5 | 4 | −3.0 | 12 |
| Example 27 | 32 | 20 | 27.9 | 19.1 | 1 | 4.0 | 15 |
| Example 28 | 23 | 24.6 | 36 | 14 | 2.4 | −4.8 | 14 |
| Example 29 | 34 | 20.6 | 26 | 15.7 | 3.7 | 9.2 | 25 |
| Example 30 | 25 | 20.5 | 36 | 15 | 3.5 | −9.0 | 23 |
| Example 31 | 30 | 25.5 | 30 | 10.5 | 4 | 11.0 | 33 |
| Example 32 | 26.5 | 17 | 35 | 17.5 | 4 | −13.0 | 33 |
| Comparative Example 10 | 26 | 20 | 0 | 51.3 | 2.7 | −8.0 | 56 |
| Comparative Example 11 | 26 | 20 | 51.3 | 0 | 2.7 | −8.0 | 57 |
| Comparative Example 12 | 28 | 20.5 | 36 | 15.5 | 0 | −3.0 | 65 |

TABLE 3

| | Results for image characteristics evaluation | | | | Restorability |
|---|---|---|---|---|---|
| | 35° C. 85% RH (HH) | 25° C. 50% RH (NN) | 10° C. 15% RH (LL) | Restorability from fatigue due to transfer | from intense light-induced fatigue |
| Example 1 | ◎ | ◎ | ◎ | ◎ | ◎ |
| Example 2 | ◎ | ◎ | ◎ | ◎ | ◎ |
| Example 3 | ◎ | ◎ | ◎ | ◎ | ◎ |
| Example 4 | ◎ | ◎ | ◎ | ◎ | ◎ |
| Example 5 | ○ | ◎ | ○ | ○ | ○ |
| Example 6 | ○ | ◎ | ○ | ○ | ○ |
| Example 7 | ○ | ○ | Δ | Δ | Δ |
| Example 8 | ○ | ○ | Δ | ○ | Δ |
| Comparative Example 1 | X | Δ | Δ | X | Δ |
| Comparative Example 2 | X | Δ | Δ | Δ | X |
| Comparative Example 3 | X | X | X | X | X |
| Example 9 | ◎ | ◎ | ◎ | ◎ | ◎ |
| Example 10 | ◎ | ◎ | ◎ | ◎ | ◎ |
| Example 11 | ◎ | ◎ | ◎ | ◎ | ◎ |
| Example 12 | ○ | ◎ | ○ | ◎ | ○ |
| Example 13 | ○ | ◎ | ○ | ○ | ◎ |
| Example 14 | ○ | ○ | ○ | ○ | ○ |
| Example 15 | ○ | ○ | Δ | Δ | ○ |
| Example 16 | ○ | ○ | Δ | Δ | Δ |
| Comparative Example 4 | X | Δ | Δ | Δ | X |
| Comparative Example 5 | X | X | Δ | X | Δ |
| Comparative Example 6 | X | X | X | X | X |

TABLE 4

| | Results for image characteristics evaluation | | | | Restorability |
|---|---|---|---|---|---|
| | 35° C. 85% RH (HH) | 25° C. 50% RH (NN) | 10° C. 15% RH (LL) | Restorability from fatigue due to transfer | from intense light-induced fatigue |
| Example 17 | ◎ | ◎ | ◎ | ◎ | ◎ |
| Example 18 | ◎ | ◎ | ◎ | ◎ | ◎ |
| Example 19 | ◎ | ◎ | ◎ | ◎ | ◎ |
| Example 20 | ◎ | ◎ | ◎ | ○ | ◎ |
| Example 21 | ○ | ◎ | ○ | ○ | ○ |
| Example 22 | ○ | ◎ | ○ | ○ | ○ |
| Example 23 | ○ | ○ | Δ | ○ | Δ |
| Example 24 | ○ | ○ | Δ | Δ | Δ |
| Comparative Example 7 | X | X | Δ | X | X |
| Comparative Example 8 | X | Δ | Δ | Δ | X |
| Comparative Example 9 | X | X | X | X | X |
| Example 25 | ◎ | ◎ | ◎ | ◎ | ◎ |
| Example 26 | ◎ | ◎ | ◎ | ◎ | ◎ |
| Example 27 | ◎ | ◎ | ◎ | ◎ | ◎ |
| Example 28 | ○ | ◎ | ○ | ◎ | ◎ |
| Example 29 | ○ | ◎ | ○ | ○ | ○ |
| Example 30 | ○ | ○ | ○ | ○ | ○ |
| Example 31 | ○ | ○ | Δ | Δ | Δ |
| Example 32 | ○ | ○ | Δ | Δ | ○ |
| Comparative Example 10 | X | X | Δ | X | X |
| Comparative Example 11 | X | X | Δ | X | Δ |
| Comparative Example 12 | X | X | X | X | X |

According to Tables 1 to 4, it can be seen that when dicarboxylic acids including isophthalic acid, adipic acid and the like, diols including neopentyl glycol and the like, trimethylols including trimethylolpropane and the like, and diamines including benzoguanamine are used as constituent monomers, the electric potential characteristics and the image characteristics are simultaneously attained under various environments, and also the restorability from fatigue due to transfer and the restorability from intense light-induced fatigue are also simultaneously attained. It is even more desirable to use the constituent monomers described above and to have the composition ratio in the range of values given by the expression (1), and it can be seen that in that case, the amount of variation in electric potential after exposure under various environments is 30 V or less, and the image characteristics (fogging, black dots) become satisfactory to a level of ○ or higher in all environments.

Furthermore, according to Comparative Examples 1 to 12, when any of the diols including neopentyl glycol and the like, the triols including trimethylolpropane and the like, and the diamines including benzoguanamine and the like, is not included in the constituent monomers, the amount of variation in electric potential after exposure under various environments is 50 V or greater for all of the combinations of charge generation layer and charge transport layer, and failures such as fogging and black dots occur in the image characteristics under various environments. Furthermore, it can be seen that the restorability from fatigue due to transfer and the restorability from intense light-induced fatigue are poor.

Thus, it is understood from Examples 1 to 32 that the effect is augmented by using the undercoat layer 2 of the present invention, while the effect is not dependent on the combination of the charge generation layer 4 and the charge transport layer 5.

The invention claimed is:

1. An electrophotographic photoreceptor, comprising:

an electroconductive substrate;

an undercoat layer provided on the electroconductive substrate and comprised of:

metal oxide fine particles including particles of at least one metal oxide and at least one organic compound provided on the particles of the at least one metal oxide as a surface treatment; and a copolymer resin synthesized by copolymerization of essential constituent monomers comprised of a dicarboxylic acid, a diol, a triol and a diamine; and a photosensitive layer laminated on the undercoat layer.

2. The electrophotographic photoreceptor according to claim 1, wherein when the copolymerization ratio of the dicarboxylic acid is designated as a (mol %), the copolymerization ratio of the diol is designated as b (mol %), the copolymerization ratio of the triol is designated as c (mol %), and the copolymerization ratio of the diamine is designated as d (mol %), and wherein a, b, c and d satisfy expression (1) as follows:

$$-10<a-(b+c+d)<10 \quad (1).$$

3. The electrophotographic photoreceptor according to claim 2, wherein the dicarboxylic acid includes at least one of an aromatic dicarboxylic acid and an aliphatic dicarboxylic acid, and when the copolymerization ratio of the aromatic dicarboxylic acid is designated as a1 (mol %), and the copolymerization ratio of the aliphatic dicarboxylic acid as a2 (mol %), a in expression (1) is: a=a1+a2.

4. The electrophotographic photoreceptor according to claim 3, wherein a1 ranges from 23 to 39 mol %, a2 ranges from 11 to 27 mol %, b ranges from 21 to 37 mol %, c ranges from 6 to 22 mol %, and d ranges from 0.01 to 15 mol %.

5. The electrophotographic photoreceptor according to claim 3, wherein the dicarboxylic acid is the aromatic dicarboxylic acid isophthalic acid, or the aliphatic dicarboxylic acid adipic acid.

6. The electrophotographic photoreceptor according to claim 3, wherein the dicarboxylic acid includes the aromatic dicarboxylic acid isophthalic acid, and the aliphatic dicarboxylic acid adipic acid.

7. The electrophotographic photoreceptor according to claim 1, wherein the diol is neopentyl glycol.

8. The electrophotographic photoreceptor according to claim 1, wherein the triol is trimethylolpropane.

9. The electrophotographic photoreceptor according to claim 1, wherein the diamine is benzoguanamine.

10. The electrophotographic photoreceptor according to claim 1, wherein the copolymer resin is synthesized by copolymerization of essential constituent monomers including at least one of isophthalic acid and adipic acid as the dicarboxylic acid, neopentyl glycol as the diol, trimethylolpropane as the triol, and benzoguanamine as the diamine.

11. The electrophotographic photoreceptor according to claim 1, wherein the particles of at least one metal oxide are particles selected from the group consisting of titanium oxide, tin oxide, zinc oxide and copper oxide.

12. The electrophotographic photoreceptor according to claim 1, wherein the at least one organic compound is selected from the group consisting of a siloxane compound, an alkoxysilane compound and a silane coupling agent.

13. The electrophotographic photoreceptor according to claim 1, wherein the undercoat layer contains a melamine resin.

14. The electrophotographic photoreceptor according to claim 1, wherein the photosensitive layer comprises at least one binder selected from the group consisting of a polycarbonate resin, a polyester resin, a polyamide resin, a polyurethane resin, a vinyl chloride resin, a vinyl acetate resin, a phenoxy resin, a polyvinyl acetal resin, a polyvinyl butyral resin, a polystyrene resin, a polysulfone resin, a diallyl phthalate resin, and a methacrylic acid ester resin.

15. A process for producing the electrophotographic photoreceptor according to claim 1, the process comprising:

preparing a coating liquid for said undercoat layer comprised of metal oxide fine particles including particles of at least one metal oxide and at least one organic compound provided on the particles of the at least one metal oxide as a surface treatment, and a copolymer resin synthesized by copolymerization of essential constituent monomers comprised of a dicarboxylic acid, a diol, a triol and a diamine;

applying the coating liquid on said electroconductive substrate to form said undercoat layer; and laminating said photosensitive layer on the undercoat layer.

16. An electrophotographic device, comprising:

the electrophotographic photoreceptor according to claim 1 wherein the electroconductive substrate has a drum shape;

a roller charging member that is disposed around the outer periphery of the electrophotographic photoreceptor;

a high voltage power supply which supplies an applied voltage to the roller charging member;

an image exposure member;

a developing machine equipped with a developing roller;

a paper supply member equipped with a paper supply roller and a paper supply guide;

a transfer charger that is a direct charging type;

a cleaning device equipped with a cleaning blade; and a charge eliminating member.

17. An electrophotographic device, comprising:

the electrophotographic photoreceptor according to claim 1 wherein the electroconductive substrate has a drum shape;

a charging member effective to produce a charge on the electrophotographic photoreceptor in an electrification process;

an imaging exposure member effective to produce an electrophotographic image on the electrophotographic photoreceptor in an imaging process; and a developing machine effective to develop the electrophotographic image in a development process.

* * * * *